US006134755A

United States Patent [19]

McDaniel

[11] Patent Number: 6,134,755

[45] Date of Patent: Oct. 24, 2000

[54] IRON-ON HOOK-AND-LOOP TYPE FASTENER

[76] Inventor: Judy Ann McDaniel, 122 Choctaw Cir., Harriman, Tenn. 37748

[21] Appl. No.: 09/248,426

[22] Filed: Feb. 11, 1999

[51] Int. Cl.[7] ..... A44B 11/00; A44B 18/00

[52] U.S. Cl. ..... 24/306; 24/442

[58] Field of Search ..... 24/306, 442, 452; 428/100; 2/116, 47

[56] References Cited

U.S. PATENT DOCUMENTS

| | | | |
|---|---|---|---|
| 2,524,842 | 10/1950 | Slamon et al. | 2/116 |
| 4,656,673 | 4/1987 | Easton et al. | 2/47 |
| 5,048,160 | 9/1991 | Goodrich et al. | 24/306 |
| 5,655,268 | 8/1997 | Keyaki et al. | 24/306 X |
| 5,989,678 | 11/1999 | Jacobson | 428/100 |

*Primary Examiner*—Robert J. Sandy
*Attorney, Agent, or Firm*—Pitts & Brittian, P.C.

[57] ABSTRACT

An iron-on hook-and-loop type fastener for effectively securing at least one portion of a hook-and-loop type fastener to a selected material using a heat-sensitive adhesive. The fastener of the present invention includes at least one cooperating portion of a conventional hook-and-loop type fastener and a base member. The base member is a fabric having a heat sensitive adhesive disposed on the bottom face thereof The cooperating portion of the hook-and-loop type fastener is secured to the top face of the base member in a conventional manner such as by sewing at least one row of stitches along the longitudinal center of the fastener portion. The base member defines a width greater than that of the fastener portion in order to provide a greater surface area of engagement between the base member and the material to which it is secured. In order to secure the fastener portion to a selected material, the free edge of the fastener portion is lifted and a hot iron is applied to the top face of the base member. Heat is transferred to the bottom face of the base member to activate the adhesive and create a bond between the base member and the material. After one side of the base member has been secured to the material, the remaining free edge of the fastener portion is lifted and the process is repeated on the remaining portion of the base member.

5 Claims, 2 Drawing Sheets

IRON-ON HOOK-AND-LOOP TYPE FASTENER

TECHNICAL FIELD

This invention relates to the field of hook-and-loop type fasteners. More specifically, this invention relates to an improved hook-and-loop type fastener having a mechanism for effectively ironing the fastener to a selected fabric.

BACKGROUND ART

It is well known in the art of fastening devices to use hook-and-loop type fasteners, commonly referred to as Velcro®, for temporarily securing two objects together. Hook-and-loop type fasteners include two cooperating portions—a hook portion defining a plurality of hooks and a loop portion which defines a nap in which the hooks are engaged. The particular configuration of the hooks is selected to accomplish various strengths of engagement. To this extent, it is well-known to manufacture hook-and-loop type fasteners to accomplish various strengths of bonds.

It is also well known to configure hook-and-loop type fasteners to be secured to selected components to be held in close proximity in various different manners. It is common, for example, to provide a hook-and-loop type fastener having no particular securing mechanism such that each cooperating portion thereof may be sewn to two pieces of fabric to be held together when the cooperating portions of the hook-and-loop type fastener are mated. However, sewing the a hook-and-loop type fastener to a piece of material can be time-consuming and difficult, especially when large quantities of the fastener are required.

Another conventional manner of securing the cooperating portions of a hook-and-loop type fastener to selected object is with an adhesive coating applied to the back of each cooperating portion. Typical adhesives employed in this manner are sufficient for application on a rigid surface such as wood or metal. However, application of an adhesive-backed hook-and-loop type fastener has proven impractical for use on fabrics such as in clothing or other applications where the fastener must also be pliable and where the article to which it is attached is washed and dried in conventional manners. In such applications, while the adhesive may be effective initially, sufficient wicking into the material does not take place in order to maintain a bond.

Yet another conventional manner of securing a hook-and-loop type fastener to an article is by providing a heat-sensitive material to the back of each cooperating portion in order to iron each portion to the selected articles. However, it has also been shown that the products currently available do not perform their desired functions sufficiently. Another deficiency in coating the back of a cooperating portion of the fastener with a heat-sensitive adhesive is the degradation of the hook surface and the loop surface when the fastener portion is secured to the selected article. Specifically, when mounting the particular fastener portion, heat must be applied through the top side thereof in order to activate the adhesive. Direct application of heat, especially to the hooks, may destroy the particular fastener portion due to the characteristics of the material of manufacture. On the contrary insufficient heat will not activate the adhesive.

One apparent reason for the failures of conventional hook-and-loop type fasteners is that in order to achieve an effective engagement between the hook and loop portions of the fastener, the substrate on which the hooks and loops are formed is an acrylic based material. This type of material does not allow for effective wicking of an adhesive—whether pressure-sensitive or heat-sensitive—therein, thus yielding a separation of the fastener portion from the adhesive. Accordingly, the most effective manner of fastening a hook-and-loop type fastener to a fabric has been, to date, sewing.

Accordingly, it is an object of this invention to provide a means for effectively securing at least one portion of a hook-and-loop type fastener to a selected material using a heat-sensitive adhesive.

Another object of the present invention is to provide a means whereby the hook-and-loop type fastener may be iron onto a flexible material with a resulting bond sufficient to withstand repeated flexion of the material, as well as subjection to convention washing and drying methods.

Still another object of the present invention is to provide such a hook-and-loop type fastener whereby securement of the fastener using a conventional heat treatment application such as ironing does not destroy the engagement portions of the fastener itself.

DISCLOSURE OF THE INVENTION

Other objects and advantages will be accomplished by the present invention which serves is provided for effectively securing at least one portion of a hook-and-loop type fastener to a selected material using a heat-sensitive adhesive. Further, the fastener is constructed in such a way as to be ironed onto a flexible material with a resulting bond sufficient to withstand repeated flexion of the material, as well as subjection to convention washing and drying methods. Moreover, the fastener of the present invention is secured using a conventional heat treatment application without destroying the engagement portions of the fastener itself.

The fastener of the present invention includes at least one cooperating portion of a conventional hook-and-loop type fastener and a base member. The base member is a fabric having a heat sensitive adhesive disposed on the bottom face thereof The cooperating portion of the hook-and-loop type fastener is secured to the top face of the base member in a conventional manner such as by sewing at least one row of stitches along the longitudinal center of the fastener portion. The base member defines a width greater than that of the fastener portion in order to provide a greater surface area of engagement between the base member and the material to which it is secured.

In order to secure the fastener portion to a selected material, the free edge of the fastener portion is lifted and a hot iron is applied to the top face of the base member. Heat is transferred to the bottom face of the base member to activate the adhesive and create a bond between the base member and the material. After one side of the base member has been secured to the material, the remaining free edge of the fastener portion is lifted and the process is repeated on the remaining portion of the base member.

BRIEF DESCRIPTION OF THE DRAWINGS

The above mentioned features of the invention will become more clearly understood from the following detailed description of the invention read together with the drawings in which.

BEST MODE FOR CARRYING OUT THE INVENTION

Figures 1, 2, 3, 4, 5:
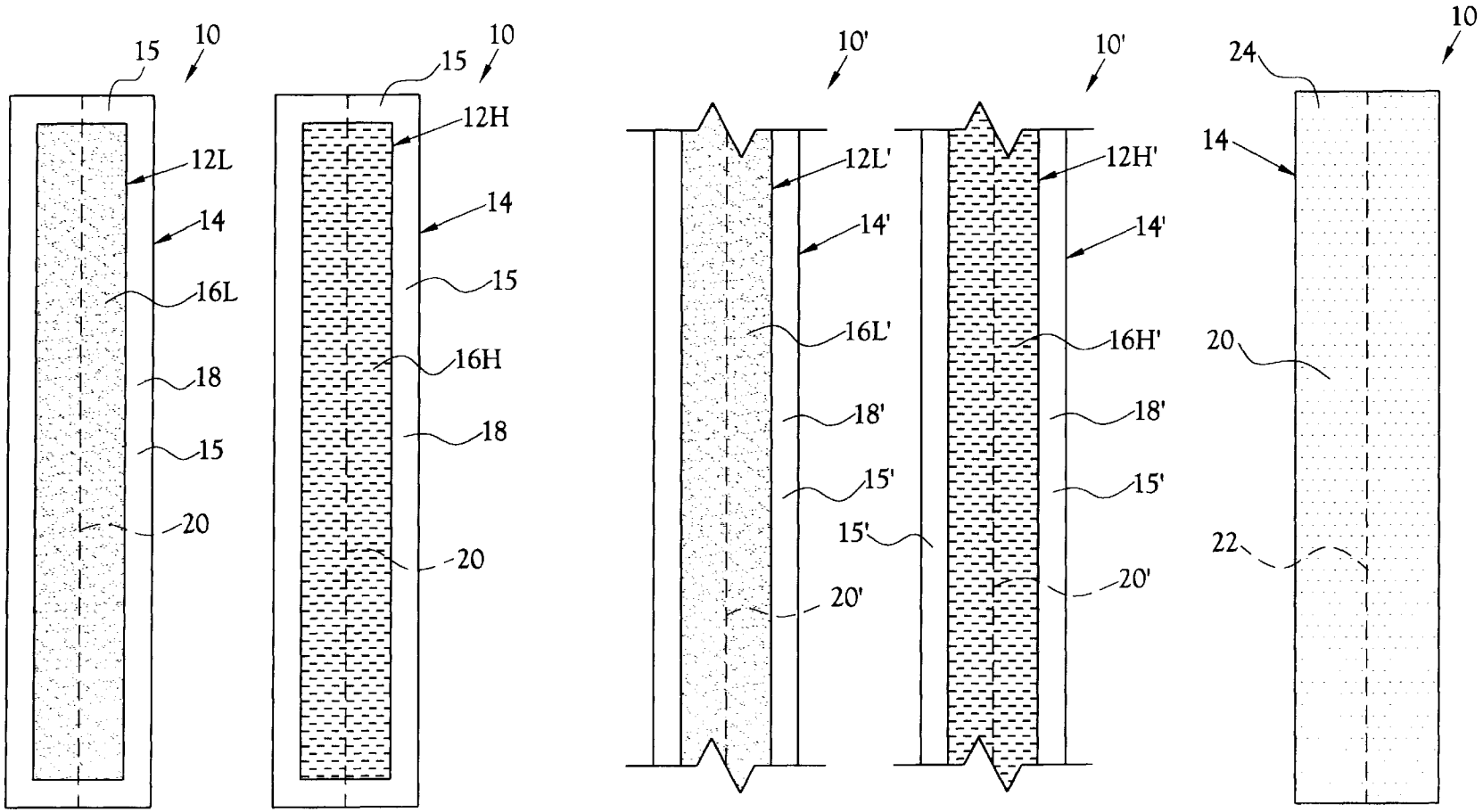
FIG. 1 is a top plan view of the loop portion of the iron-on hook-and-loop type fastener constructed in accordance with several features of the present invention, the loop portion having a finite length.
FIG. 2 is a top plan view of the hook portion of the iron-on hook-and-loop type fastener configured to cooperate with the loop portion illustrated in FIG. 1.
FIG. 3 is a top plan view of the loop portion of the iron-on hook-and-loop type fastener constructed in accordance with several features of the present invention, the loop portion shown being a portion of an undefined length.
FIG. 4 is a top plan view of the hook portion of the iron-on hook-and-loop type fastener configured to cooperate with the loop portion illustrated in FIG. 3.
FIG. 5 illustrates a bottom plan view of one cooperating portion of the hook-and-loop type fastener of the present invention.

An iron-on hook-and-loop type fastener incorporating various features of the present invention is illustrated generally at 10 in the figures. The iron-on hook-and-loop type fastener, or fastener 10,is designed for effectively securing at least one portion 12 of a hook-and-loop type fastener to a selected material 26 using a heat-sensitive adhesive 24. Further, the fastener 10 is constructed in such a way as to be ironed onto a flexible material 26 with a resulting bond sufficient to withstand repeated flexion of the material 26, as well as subjection to convention washing and drying methods. Moreover, the fastener 10 of the present invention is secured using a conventional heat treatment application without destroying the engagement portions 16 of the fastener portion 12 itself.

Figure 6:
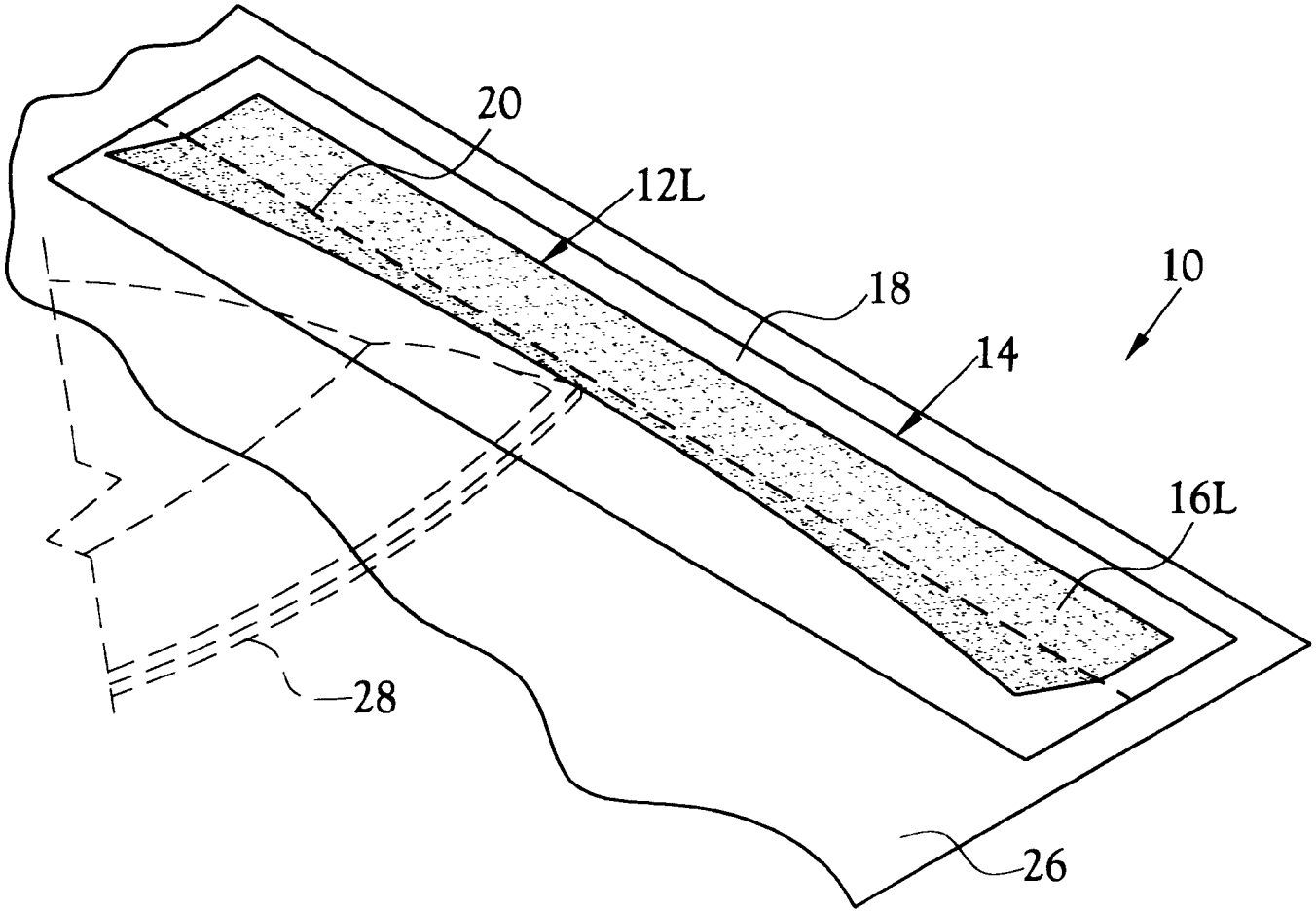
FIG. 6 is a perspective view of the hook-and-loop type fastener of FIG. 1, showing a conventional iron being used to secure the loop portion to a selected object.

The fastener 10 of the present invention is primarily comprised of at least one cooperating portion 12 of a conventional hook-and-loop type fastener and a base member 14. The base member 14 of the preferred embodiment is a fabric having a heat sensitive adhesive 24 disposed on the bottom face 20 thereof. One conventional product is commonly known as mending tape. The cooperating portion 12 of the hook-and-loop type fastener is secured to the top face 18 of the base member 14 in a conventional manner such as by sewing. In the illustrated embodiment, the preferred method of securing the fastener portion 12 to the base member 14 is by sewing at least one row of stitches 22 along the longitudinal center of the fastener portion 12. As best illustrated in FIG. 6, by securing the fastener portion 12 and base member 14 in such a manner, the edges of the fastener portion 12 may be lifted to allow a conventional iron 28 to apply heat directly to the base member 14 without applying direct heat to the engagement device 16 of the fastener portion 12. For purposes of describing the present invention the engagement device 16 is defined as the loop 16L of a loop portion 12L and the hook 16H of a hook portion 12H. By providing for the lifting of the edge of the fastener portion 21, greater heat is delivered to the heat-sensitive adhesive 24, thereby accomplishing a stronger bond between the base member 14 and the selected material 26. Further, a greater effective surface are may be heat treated.

As best illustrated in FIGS. 14, the base member 14 of the preferred embodiment defines a width greater than that of the fastener portion 12. By having such configuration, a greater surface area of engagement is defined between the base member 14 and the material 26 to which it is secured. Further, although not illustrated, it is envisioned that the fastener portion 12 may be fastened to the base member 14 along the edges of the fastener portion 12, leaving no area under which a conventional iron may be passed in order to activate the corresponding area of heat-sensitive adhesive 24. In the illustrated embodiment where the base member 14 defines a greater width than the fastener portion 12, an extended portion 15 of the base member 14 is defined for application of heat thereto for adhesion to the selected material 26. However, it will be understood that the dimensions of the base member 14 may be selected independently of the dimensions of the fastener portion 12. Specifically, the width of the base member 14 may be narrower than, equal to, or broader than the width of the fastener portion 12, depending on the particular application of the fastener 10.

FIG. 1 illustrates a finite length of a loop portion 12L secured to a base member 14 by sewing a stitch row 20 along the longitudinal axis thereof The base member 14 in this embodiment defines a length longer than that of the loop portion 12L, and a width broader than that of the loop portion 12L. FIG. 2 illustrates a hook portion 12H configured to cooperate with the loop portion 12L illustrated in FIG. 1. FIGS. 3 and 4 illustrate a loop portion 12L' and a hook portion 12H' similar to those in FIG. 1 and 2, respectively, with the exception that they are portions of a continuous length of a loop portion 12L' and a hook portion 12H'. In the latter embodiment, the desired portion of the respective loop portion 12L' and hook portion 12H' are cut from a continuous length thereof As in the previous embodiment, the extended portion 15' extends the entire length of the base member 14'. However, due to the nature of the continuous length of the fastener 10', there are no extended portions 15 provided at the ends of cut portion of the fastener 10'.

FIG. 5 illustrates the bottom face 20 of the base member 14 on which is applied the heat-sensitive adhesive 24. As illustrate, the adhesive 24 is applied to the entire bottom face 20 in order to allow greater adhesion to the selected material 26. The adhesive 24 of the preferred embodiment yields a bond between the base member 14 and the material 26 sufficient to withstand repeated flexion of the material 26 and base member 14, and to withstand repeated washing and drying using conventional methods. Such heat sensitive adhesives are known and readily available to those skilled in the art.

FIG. 6 illustrates the method in which the fastener 10 of the present invention is mounted to a selected material 26. Specifically, the free edge of the fastener portion 12 is lifted and a hot iron 28 is applied to the top face 18 of the base member 14. Heat is transferred to the bottom face 20 of the base member 14 to activate the adhesive 24 and create a bond between the base member 14 and the material 26. After one side of the base member 14 has been secured to the material 26, the remaining free edge of the fastener portion 12 is lifted and the process is repeated on the remaining portion of the base member 14.

From the foregoing description, it will be recognized by those skilled in the art that an iron-on hook-and-loop type fastener offering advantages over the prior art has been provided. Specifically, the fastener of the present invention is provided for effectively secured at least one portion of a hook-and-loop type fastener to a selected material using a heat-sensitive adhesive. The fastener is constructed in such a way as to be ironed onto a flexible material with a resulting bond sufficient to withstand repeated flexion of the material, as well as subjection to convention washing and drying methods. The fastener of the present invention is secured using a conventional heat treatment application without destroying the engagement portions of the fastener itself.

While a preferred embodiment has been shown and described, it will be understood that it is not intended to limit the disclosure, but rather it is intended to cover all modifications and alternate methods falling within the spirit and the scope of the invention as defined in the appended claims.

I claim:

1. An iron-on hook-and-loop type fastener comprising:

a base member;

a heat-sensitive adhesive disposed on a bottom face of said base member; and at least one fastening portion of a conventional hook-and-loop type fastener;

said fastening portion being secured to a top face of said base member in a conventional manner thereby providing at least a portion of said base member capable of being directly exposed to a heat source without directly exposing said fastening portion to said heat source.

2. The iron-on hook-and-loop fastener of claim 1 wherein said fastening portion is secured to said base member by sewing at least one stitch row parallel to a longitudinal axis of each of said base member and said fastening portion, at least a portion of said fastening portion remaining unsecured to said base member to facilitate direct access to at least a portion of said base member.

3. The iron-on hook-and-loop fastener of claim 2 wherein said stitch row is disposed along said longitudinal axis of each said base member and said fastening portion such that one said unsecured portion is disposed on each side of said stitch row.

4. A method for converting a conventional hook-and-loop type fastener to be secured to a selected material by application of heat, said method comprising the steps of:

placing a fastening portion of said hook-and-loop type fastener over a top face of a base member, a heat-sensitive adhesive being disposed on a bottom face of said base member; and securing said fastening portion to said base member thereby Providing at least a portion of said base member capable of being directly exposed to a heat source without directly exposing said fastening portion to said heat source.

5. The method of claim 4 wherein said step of securing said fastening portion to said base member is accomplished by sewing a stitch row along a longitudinal axis of both of said fastening portion and said base member such that at least a portion of said fastening portion remains unsecured to said base member to facilitate direct access to at least a portion of said base member.

* * * * *